United States Patent [19]

Domdey

[11] Patent Number: 4,495,774

[45] **Date of Patent: * Jan. 29, 1985**

[54] PROCESS FOR GENERATING ELECTRIC POWER BY MEANS OF TURBOGENERATORS USING HIGH PRESSURE VAPOR

[76] Inventor: Otto Domdey, Buchenstrasse 58, Ludwigshafen, Fed. Rep. of Germany

[ * ] Notice: The portion of the term of this patent subsequent to Dec. 27, 2000 has been disclaimed.

[21] Appl. No.: 484,918

[22] Filed: Apr. 7, 1983

Related U.S. Application Data

[63] Continuation-in-part of Ser. No. 224,571, Nov. 6, 1980, Pat. No. 4,394,815.

[51] Int. Cl.[3] ..... F01K 25/06

[52] U.S. Cl. ..... 60/649; 60/327

[58] Field of Search ..... 60/325, 326, 327, 398, 60/486, 649, 673, 698; 290/52

[56] References Cited

U.S. PATENT DOCUMENTS

| | | | |
|---|---|---|---|
| 891,214 | 6/1908 | Graf | 60/325 X |
| 2,151,949 | 3/1939 | Turner | 60/649 |
| 4,201,049 | 5/1980 | Tobber | 60/325 |
| 4,394,815 | 7/1983 | Domdey | 60/649 |

FOREIGN PATENT DOCUMENTS

| | | | |
|---|---|---|---|
| 411559 | 4/1910 | France | 60/325 |

*Primary Examiner*—Stephen F. Husar

[57] ABSTRACT

A hydraulic turbo-generator driven by a water current is used for producing electric power; the water is supplied to the turbine (5) by means of a conduit (4). The high pressure vapor is produced in a vapor generator (2) and combined in the water current, so that the expansion energy of the vapor is transmitted to the water, if possible completely, and to the turbine. The interaction duration of the vapor and the water is considered to be a very short due to the high speed of the water, so that substantially no heat exchange occurs, thereby obtaining a plant output higher than that of conventional plants.

5 Claims, 2 Drawing Figures

PROCESS FOR GENERATING ELECTRIC POWER BY MEANS OF TURBOGENERATORS USING HIGH PRESSURE VAPOR

RELATED APPLICATIONS

The present application is a continuation-in-part of my application Ser. No. 224,571 filed Nov. 6, 1980, now U.S. Pat. No. 4,349,815.

FIELD OF THE INVENTION

The present invention relates to electric generator plants, in which turbogenerators are driven by high pressure vapor. Such generator plants characteristically operate at low efficiency.

SUMMARY OF THE INVENTION

A basic object of the invention is to provide a process to generate electric current by means of turbogenerators using high pressure vapor, at a higher efficiency.

A further object of the invention is to lead a stream of water to the turbines from water reservoirs at ambient air pressure, and to introduce high pressure vapor in like direction into the water stream, whereby the time for any interaction between the vapor and water is held so short that practically no heat-exchange between the vapor and water takes place.

Contrary therefore to the known methods of operating steam turbine power plants, according to the process of the invention vapor is led not directly into the turbines, but into a water stream which drives water turbines instead of steam turbines.

The energy of the vapor introduced into the water stream is transferred to the water stream and works to continuously increase the pressure and velocity of the water molecules, which immediately thereafter act upon the turbine. This energy transfer occurs practically without energy losses, if during the interaction of vapor and water no appreciable vapor condensation occurs. The reaction time must therefore be so short that heat exchange is substantially avoided. This may be accomplished by an adequately high water stream velocity and a short distance in which the water and vapor may interact. For example, with a water velocity of 400 m/sec and an interaction distance of 5 m the interaction time is only 0.0125 sec, which does not permit any appreciable vapor condensation. Additionally it can be shown that even at a very high impact velocity for the vapor, i.e., at a high relative velocity of the vapor as regards the water stream, such as for example approximately 500 m/sec, there results practically no supersonic impact heating of the water.

These findings allow the application of high pressure vapor in electrical power plants according to the invented process, contrary to the teachings of the prior art in this field.

Preferably high output rotary pumps are used to generate the water stream, and preferably Pelton turbines are driven by the stream of water. The water stream may form a closed circuit. The possibility also exists to use the water coming from the turbines in other ways, such as for example, for distant heating purposes. The high pressure steam may be obtained from waste heat from boilers, or from gas-supercharged steam generators; and the water stream may also derive from water reservoirs at higher altitudes which would obviate the need for a water pump.

DETAILED DESCRIPTION OF THE INVENTION

Figure 1:
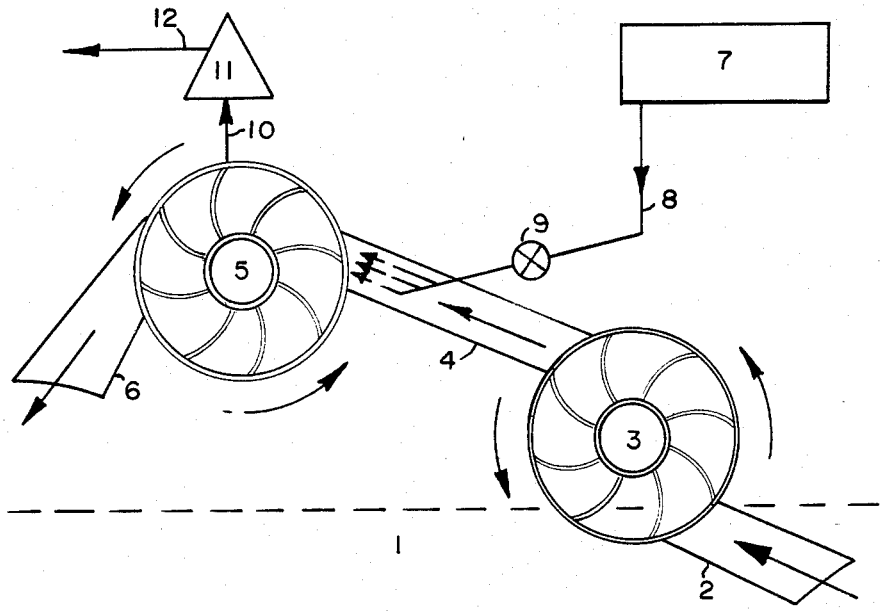
FIG. 1 schematically shows one example of an electrical power plant according to the invention.

In FIG. 1, water is taken through an inlet 2 from a water reservoir 1 by means of a high output rotary pump 3, and is led, at a very high velocity, via a short cylindrical conduit 4 into the hydraulic turbine 5 of a turbogenerator, from which the water is recycled to the water reservoir 1, with run-off at 6.

High pressure vapor is drawn from a steam generator 7, let into the conduit 4 by means of a steam conduit 8, which includes a regulating valve 9, and then injected into the water stream in a like direction of flow as that of the water stream. Being expansive, the injected high pressure vapor will, in the presence of a constant magnetic field resistance, accelerate the water's speed of passage through the turbine 5 and thus effect acceleration of rotation of the turbogenerator. The resulting increased power output of the generator will be greater than the power output required to generate the water stream, which means an increase in the overall efficiency of the plant.

For example, the following operating data are assumed:

| | |
|---|---|
| water flow (constant) | 100 to/sec. |
| water velocity | 400 m/sec. |
| water pressure | 40 bar |
| vapor stream velocity | 875 m/sec. |
| vapor pressure | 40 bar |

From these figures, according to the known efficiency factors regarding the singular plant units involved, there results the following power data:

| | |
|---|---|
| pumping power intake | 436 Mw. |
| steam power output | 260 Mw. |
| generator power output | 532 Mw. |

The overall efficiency factor is given by the proportion of generator power output minus pumping power intake to the steam power applied, which in the case preceding totals 0.37. This is therefore already somewhat better than the efficiency factor 0.30 for most of the large scale electrical power plants in operation.

Another example shows, how with changed conditions, the overall efficiency factor of the plant may yet be higher. With an increase primarily in the vapor pressure, the following operating data may be assumed:

| | |
|---|---|
| water flow (constant) | 100 to/sec. |
| water velocity | 850 m/sec. |
| water pressure | 20 bar. |
| vapor steam velocity | 1325 m/sec. |
| vapor pressure | 180 bar. |

In this case there results:

| | |
|---|---|
| pumping power intake | 463 Mw. |
| steam power intake | 958 Mw. |

-continued

| | |
|---|---|
| generator power output | 1066 Mw. |

The overall efficiency factor in this case is 0.63.

If energy affects water molecules simultaneously, as to pressure and velocity, this represents an energy and impulse transfer. Such an energy and impulse transfer follows the physical concept of energy and impulse equalization. This again encompasses the physical process of the full elastic collision during the short mutual interaction time for the steam and for the water (the components of mass are mutually not compressible). Within this context of full elastic collisions occurring, the non-bernoullic pressure and velocity characteristics of the high pressure steam, travelling at supersonic velocities, are being transferred to the water within a short space of time. The possibility of choosing a desired velocity increase and/or pressure increase for the water in utilizing this mutual interaction of vapor and water remains wholly the function of an adequately chosen and/or set magnetic field resistance of the turbogenerator, and is therefore contemplated for this invented process, to be determined according to the desired manner of application, and therefore does not stand in contradiction to the affirmative statement of functional proportion discussed earlier.

Figure 2:
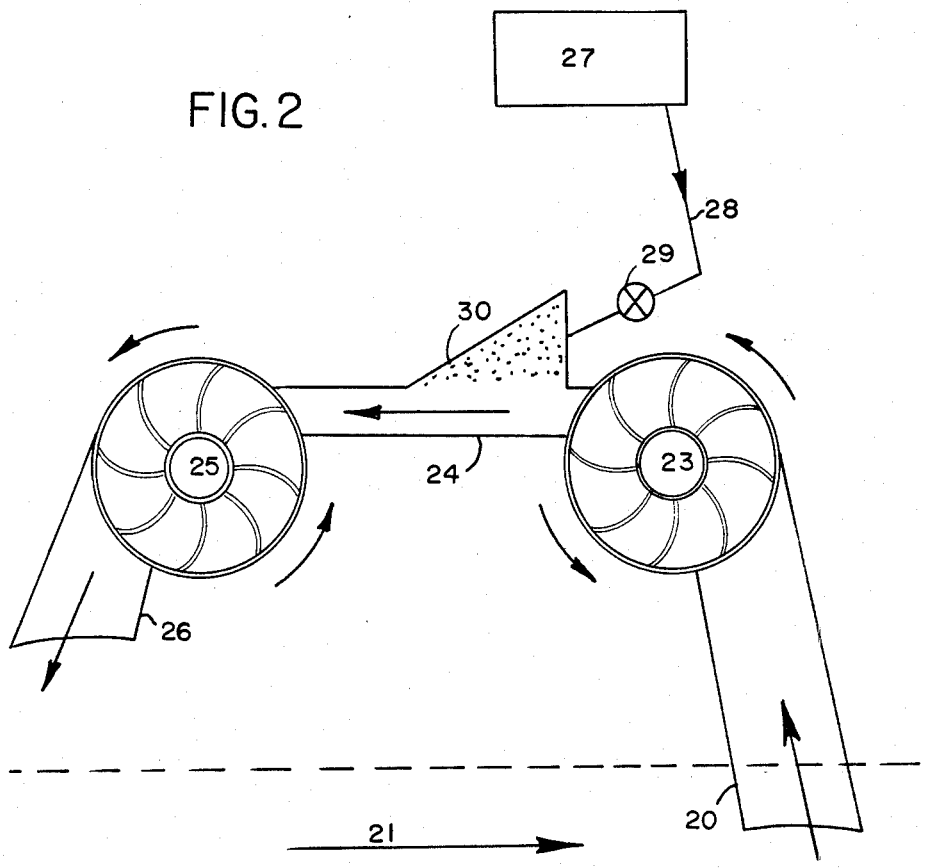
FIG. 2 schematically shows another embodiment of the invented process.

The embodiment of FIG. 2 differs from the embodiment of FIG. 1 in that the high pressure vapor is combined with the water stream without injecting the vapor into the water stream.

In FIG. 2, the water stream may form a closed circuit, and the high pressure vapor may be obtained from waste heat of boilers or from gas-supercharged steam generators. Water is then taken through an inlet 20 from a water reservoir 21, by means of a high output rotary pump 23, and is led at a very high velocity via a short cylindrical conduit 24 into the hydraulic turbine 25 of a turbogenerator, from which water is recycled to the water reservoir 21, with run-off at 26.

Into that water stream a cloud of high pressure vapor is inserted, with energy flow in like direction by means of a chamber 30 exposed on one side to the water stream. The vapor is drawn from a steam generator 27 and is led into the conduit 24 by means of a steam conduit 28, which includes an inlet valve 29.

The resulting increased power output of the generator will be greater than the output required to generate the water stream, with practically no energy losses from the vapor energy applied, which means an increase in the overall efficiency of the plant.

Vapor condensation, vapor expansion, and evidently also supersonic heating losses of energy occur in steam turbines. Such losses occur only minimally within the invented process, i.e. the functional energy loss for the inserted high pressure vapor practically equals the energy gain for the water stream.

This substantiates the advantage of the inventive process as regards overall efficiency factors.

Practically no steam expansion effects can occur according to physical laws (Newton's Law of Heat Exchange), as the same is directly proportional to not only temperature, but also time. The basis for steam expansion within a solid column of water always is the formation of thin superheated layers of separation between steam and water respectively, which may not develop at adequate high water speeds. The water mass within the conduit is continuously renewed independently of the steam action.

Condensation of the high pressure steam cloud upon the water however cannot be stopped. However, the condensation must occur practically without heat exchange and/or without heat transfer according to this invention.

The inherent expansion energy (heat) of the high pressure vapor is therefore transformed into the maximally cooled kinetic energy of the condensate of the preceding vapor in the water upon contact, i.e. within a very short space of time and/or distance in the water, according to the invention.

The steam may not expand, and may not transfer heat, but must condense within the water. The steam therefore must condense to water, without losing its heat energy through transmission.

However, the thermal energy cannot simply disappear according to the First Law of Thermodynamics: The transformation of thermic energy of the vapor into kinetic energy practically without serious energy losses takes place according to this invention, and is transmitted to the water stream.

I claim:

1. An improvement in a process for generating electrical current by means of hydraulic turbogenerators, wherein a conduit connects a water reservoir with turbines of said turbogenerator, said conduit containing a water stream supplying motive power to said turbines, said water stream being subjected to common air pressure conditions at said reservoir, with a vapor generating chamber adjacent the water stream conduit at a point outside of the turbine space and in fluid communication with said water stream conduit, said improvement comprising:

inserting the high pressure vapor into said water stream conduit at said point outside of said turbine space into one side of said water stream, said water stream having a very high flow rate in said conduit, such that continuous pressure and velocity increases are caused in said water stream, and that practically no heat exchange takes place between the inserted vapor and the water prior to contact with the turbines.

2. The improvement as claimed in claim 1, further comprising the step of using high output rotary pumps for generating the water stream.

3. The improvement as claimed in claim 1, further comprising the step of generating the high pressure vapour in steam generators.

4. The improvement as claimed in claim 1, further comprising the step of recirculating the water discharged from the turbines, such that the water is circulated in a closed circuit.

5. The improvement as claimed in claim 1, wherein the water stream has a velocity on the order of 50 meters per second and that said high pressure vapour is inserted at a point on the order of 5 meters upstream the turbines.

* * * * *